United States Patent [19]

Delery

[11] 4,085,528

[45] Apr. 25, 1978

[54] SKI-BOOT

[75] Inventor: Marc Delery, Caluire, France

[73] Assignee: Trappeur, S. A., St-Etienne de St-Geoirs, France

[21] Appl. No.: 728,738

[22] Filed: Oct. 1, 1976

[30] Foreign Application Priority Data

Nov. 4, 1975 France ..... 75 34375

[51] Int. Cl.[2] ..... A43B 5/04

[52] U.S. Cl. ..... 36/121

[58] Field of Search ..... 36/117, 118, 119, 120, 36/121; 280/11.35 K

[56] References Cited

U.S. PATENT DOCUMENTS 3,696,534 10/1972 Hornung ..... 36/121

FOREIGN PATENT DOCUMENTS 2,049,450 5/1971 Germany ..... 36/118

2,049,957 4/1972 Germany ..... 36/118

*Primary Examiner*—Patrick D. Lawson

*Attorney, Agent, or Firm*—Arnold, White & Durkee

[57] ABSTRACT

A ski-boot having a U-shaped reinforcement with a horizontal base extending through the sole of the boot in which the upper arms of the reinforcement are secured at the top and to the rear of the boot, and bear against a major portion of the boot. The invention is concerned with injection moulded ski-boots of plastics, and preferably thermoplastics material.

18 Claims, 10 Drawing Figures

SKI-BOOT

The invention relates to an improved ski-boot of the type formed mainly by a moulded rigid body comprising an upper, integral with a sole rigidly joined to its heel, and a likewise moulded collar, sometimes called a "sleeve," which is provided at the top of the boot so that the leg of the skier is firmly enclosed.

A boot of such type is already well-known. These boots may be produced by the injection-moulding of various thermoplastic materials, such as polyurethane, synthetic elastomer, polyolefins or the like, in a mould of appropriate shape.

However, these boots, which at present are undergoing development on a large scale, still suffer from certain disadvantages particularly when they are used by competitive skiers.

Thus, in an effect to obtain great rigidity in the bodies of these boots to enable them to resist the heavy forces to which they are subjected, it is necessary to increase the thickness of the body, and this inevitably results in a reduction in the production rate, increase in the weight of the boot and, of course, a rise in the cost thereof.

Furthermore, thicker body-walls harden to a greater extent in the cold, and among the troublesome consequences that this has for the skier is that of reducing flexibility of the boot under certain conditions, particularly at temperatures below minus 10° C.

In addition, each skier has his own racing style which, apart from depending upon the physique and technique of the individual, also depends upon the state of the snow and the contours of the particular ski-run. It therefore suits top-class skiers to have boots provided with adjusting means to enable them to fit correctly around their legs. These means are concerned more particularly with flexibility (yield in the longitudinal direction), advance (the degree of mean inclination of the skier for a given contour of the ski-run) and "angulation" (mean divergence from the plane, in which the skier is moving, along the plane perpendicular to the plane of the skis resting flat on the snow).

"Flexibility" designates the ability of the boot to yield in the longitudinal direction. The boot must in fact permit a certain flexural movement indispensable in ski-ing, and at the same time prevent extreme flexion, that would be beyond the anatomical capability of the ankle, as well as excessive stretch which would cause forward over-balancing. For this purpose the boot must have a certain rigidity, but still be flexible. Ideally, the boot should possess gradually increasing flexibility.

"Advance," also called "angle of flexion," designates the angle formed by the vertical plane and the rear portion of the boot. In other words, this expression connotes the inclination of the skier in relation to the vertical. It is in fact known that, depending upon his natural balance and strength, each skier selects a more or less flexed middle attitude. If the boot is not suited to this natural attitude, i.e. if it has too much advance or lacks it, forced flexions are caused which result in a certain risk of imbalance or lift at the front of the skis.

In other words flexibility and advance act in the same plane but not necessarily at the same places, since the functions are different and depend upon the physique of each skier.

"Angulation" designates the angular divergence of the vertical plane from the plane of the leg of the skier.

In practice, this mean "angulation" is in the order of 1½° to 2°.

Among the means for adjusting flexibility, there have been provided nicks formed in the body of the boot, particularly in the median rear portion of the upper so as to impart the required shape to the upper. This practice has not met with great success if only because it does not permit reversibility.

To adjust "angulation," micrometric mechanical devices have been proposed which are inserted for example between certain portions of the body of the boot (see for example Ski Flash Magazine No. 12, page 70, November 1974). Such devices are however costly, form projections (which are therefore dangerous during ski-ing), are unattractive in appearance and take a long time to be positioned both during manufacture and use.

French Pat. No. 2,220,201 proposes a method of producing a boot, the flexibility of which can be adjusted and progressively, increased, by forming, in the toe of the moulded body, a series of transverse openings, the movement of the edges of the openings towards each other being limited by a wedge. This complicated solution greatly reduces the strength of the boot and causes problems regarding lack of water-tightness when it is worn.

In short, it would appear that so far no boot has been put on the market that has flexibility that can be adjusted and progressively increased, or that has preselectable advance.

French Pat. No. 2,166,677 proposes the adjustment of the "angulation" of the collar in relation to the upper and therefore adjustment of advance by providing, on each side of the boot, one or more screws which extend through the collar and are adapted to slide in oblong holes provided for the purpose in the upper. This solution does not however enable sufficient flexibility to be achieved, and furthermore a tool-kit is required for making the adjustments.

French Pat. No. 2,106,327 describes a flexible ski-boot, open at the back, in which the rigid collar is connected to the sole by an adjustable and "positionable" metallic fitting. This arrangement enables the lateral "angulation" to be adjusted, but does not permit any adjustment of the flexibility and the angle of flexion. Furthermore, the adjusting element of this connecting fitting that are formed for example by a tapped and screw-threaded bush or a helical spring, are complicated, expensive and, when in use, are likely to be damaged by the penetration of snow, water etc. Finally, they are also dangerous during ski-ing, since they extend beyond the sides of the boot, and this carries the risk of causing falls due to the inner faces of the pair of boots latching on to each other.

French Pat. No. 2,024,307 suggests providing a flexible boot with a U-shaped metallic reinforcement which extends from each side of the boot and the base of which passes below the sole. This solution cannot be satisfactory since the flexibility of the rigid unit stems essentially from the twisting of the reinforcement in the sole and not from the reinforcement itself. Furthermore this costly arrangement is complex and difficult to adjust, and makes ski-ing difficult if not dangerous, since the reinforcement projects completely beyond the boot. Finally, since this reinforcement is secured directly to the leg of the skier, it often causes wounds, sometimes dangerous ones.

French Pat. No. 2,063,622 also proposes providing a moulded boot having a rigid body with a metal bar bent to the shape of a U, the base and the limbs of which are embedded in the sole, the ends of the limbs carrying fixed pivots forming resilient means for enabling the top portion of the upper to swing forward. This arrangement again suffers from the disadvantage of projecting beyond the boot and therefore of rendering ski-ing difficult and even dangerous. Futhermore, it is costly, deteriorates with time and is difficult to adjust correctly. In addition, though this arrangement is theoretically able to provide satisfactory adjustment of flexibility, though only towards the front of the boot, it requires an additional means, mounted on the rear of the upper, for adjusting advance; this additional means however cooperates inefficiently with the means for regulating flexibility. Finally, with this arrangement, the U-shaped bar hardly participates in the various forces and, what is more, its structure would not enable it to withstand these forces successfully over a period of time.

The object of the present invention is to provide improved moulded ski-boots which are more satisfactory than those hitherto available, particularly as regards their weight and the cost of producing them, while at the same time incorporating means enabling the skier to adjust the position of his legs, and therefore of his entire body, in his boots, which means are mainly concerned with the above-mentioned factors, namely flexibility and advance.

According to the present invention there is provided an injection molded ski-boot of plastics and preferably thermoplastics material, said boot comprising:

a rigid upper;

a rigid sole and heel integral with the upper;

a collar surrounding the top of the upper, effective to surround the leg of the wearer;

a U-shaped reinforcement;

a horizontal base on said reinforcement which extends through the sole near the heel;

limbs on the reinforcement which extend towards the top of the boot, said limbs being each situated at the rear of the boot and which bear firmly against a major portion of the rear of the upper of the boot, one on each side of the longitudinal centre-line of the boot; and an upper arm on each limb, each upper arm being secured at a free end near to the top of the rear of the upper.

Thus, the reinforcement mainly transmits its rigidity to the boot at four points located as follows:

(i) at the point where the ends of the limbs of the reinforcement are secured to the top of the rear of the upper;

(ii) halfway between the top of the rear of the upper and the sole;

(iii) on the sides of the boot to the rear of the ankle-bone projections; and finally (iv) over the entire transverse portion of the sole immediately forward of the heel.

According to a preferred embodiment, there is provided means for adjustment of the limbs which comprises means defining two recesses symmetrical in relation to and on either side of the longitudinal centre-line of the boot;

two channelled parts each having means defining a radial groove for receiving a lower arm of said limbs, each of said recesses being adapted to receive the corresponding channelled part.

Advantageously each of these grooves comprises a reduced portion, the width of which corresponds substantially to the diameter of the reinforcement so that the latter bears firmly in this reduced portion and therefore at a single point.

According to another preferred embodiment, there is provided means for adjustment of said horizontal base comprising a transverse portion defining a recess in the sole which extends from one side of the boot to the other in front of the heel, in which recess is lodged a member which forms a wedge and in which there is means defining a longitudinal notch for the base of the reinforcement to be passed therethrough.

In one practical embodiment, this transverse recess is of cylindrical form comprising a flat substantially perpendicular to the direction in which the limbs of the U extend at this flat.

The rigid and flexible reinforcement is advantageously a U-shaped steel rod of suitable diameter, each set of upper and lower arms having been bent at an approximately midway point to an angle of between 30° and 70° and preferably 50°.

In order that the invention will be more fully understood, the following description is given, merely by way of example, reference being made to the accompanying drawings, wherein.

Figure 1:
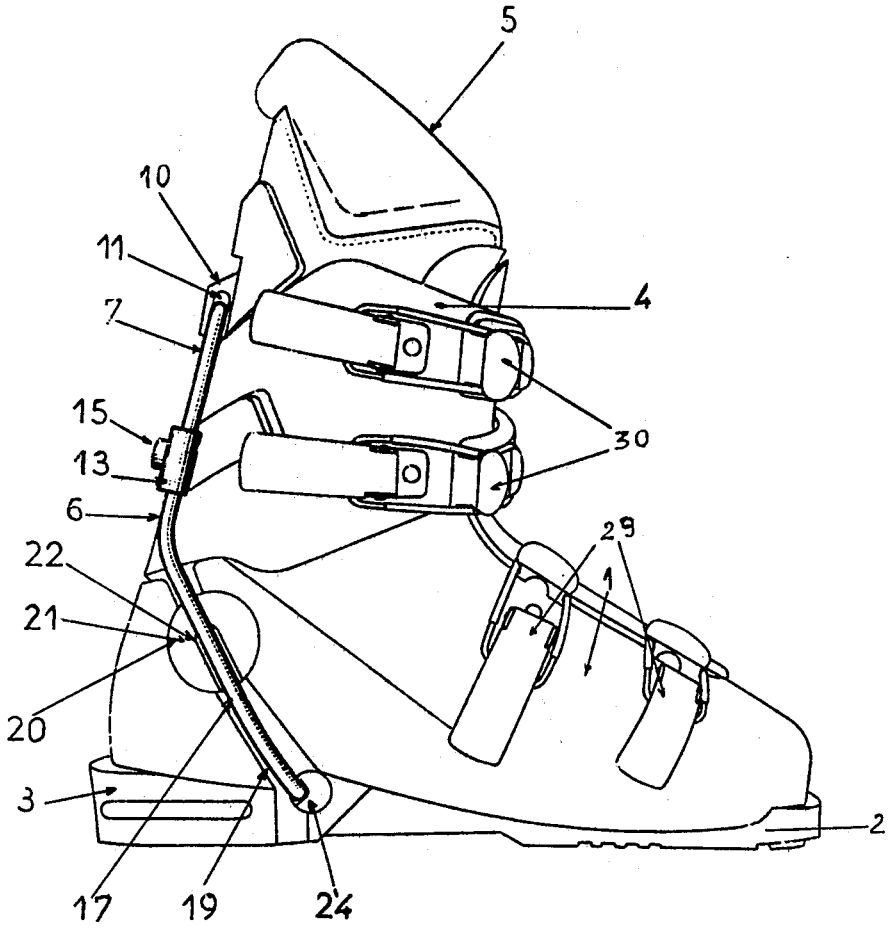
FIG. 1 is a side-view of one embodiment of ski-boot in accordance with the invention.
Figure 2:
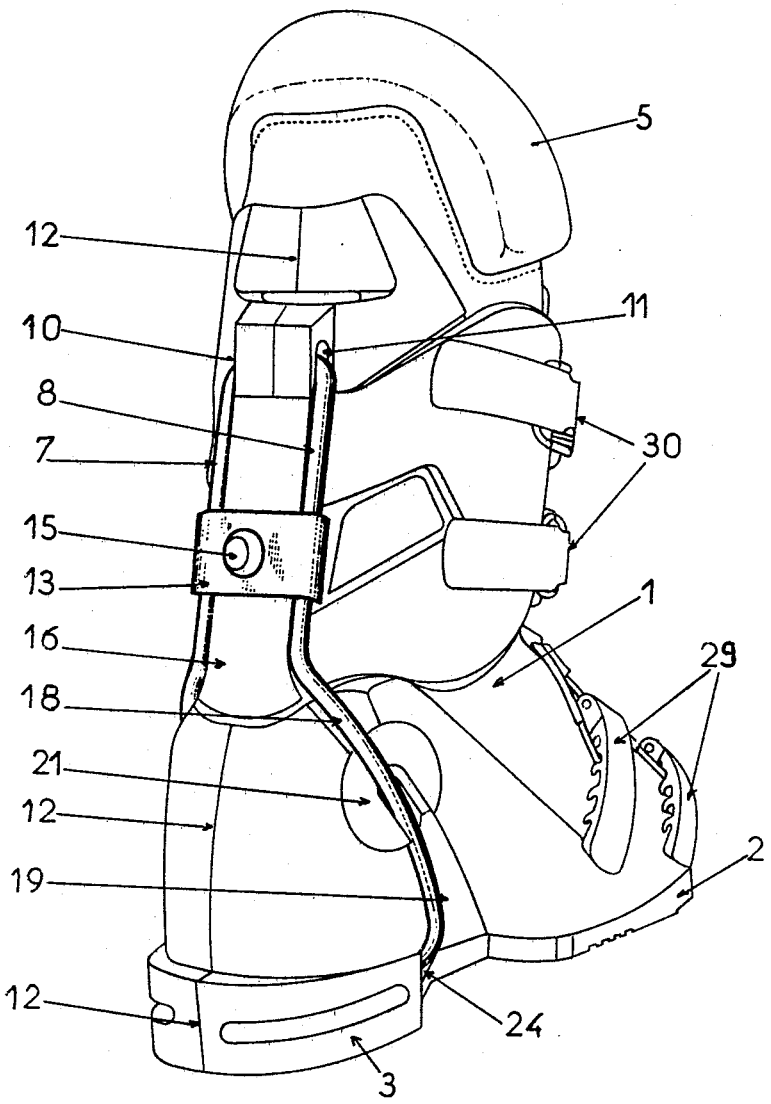
FIG. 2 is a three-quarter rear view of the same ski-boot.

The ski-boot in accordance with the invention (see FIGS. 1 and 2) comprises firstly an injection-moulded body of polyurethane or the like having an upper 1 which is integral with a sole 2 and a heel 3, which two latter parts may be strengthened by a built-in metallic reinforcement. At the top of this body is located a collar 4 which is likewise injection-moulded and which is adapted to grip the leg of the skier in the boot. The boot may also comprise, in the customary manner, a liner, faced with leather or cloth.

Figure 3:
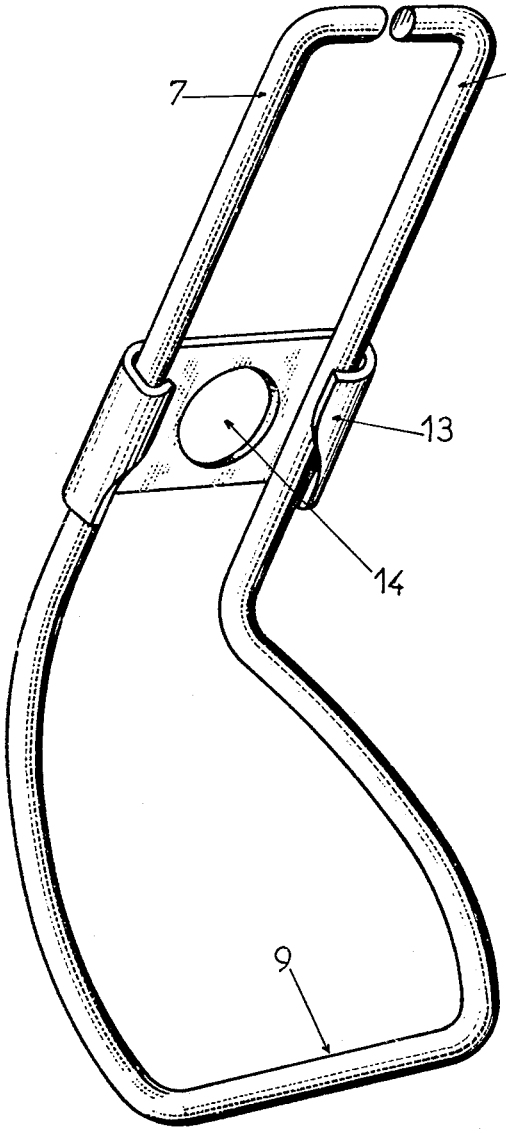
FIG. 3 illustrates a reinforcement in accordance with the invention in perspective.

The boot is also provided with a rigid and flexible reinforcement 6 (modulus of elasticity of the order of several kilograms per square millimeter) having the shape of a U as illustrated in FIG. 3. This reinforcement may have a solid cross-section, ribbed or otherwise, and preferably cylindrical with a diameter or 6½ millimeters; its material may be that known as RBl or borate-containing, with maximum and minimum ultimate tensile strength of 150 kilograms and 132 kilograms (NF A 47301 Cl Bl Standards).

This reinforcement 6 has a substantially horizontal base 9, and two limbs, each of the limbs comprising a lower arm 17 and 18 attached to the horizontal base 9, and an upper arm 7 or 8, extending from each lower arm; the plane of the two upper arms 7 and 8 is inclined to that plane of the two lower arms 17 and 18 by an angle of approximately 50° (see FIG. 3). The ends of the upper arms 7 and 8 are turned in towards one another.

The rear portion of the upper 1 has a boss 10, which is formed during moulding and which contains two oblong holes 11 in which are lodged the bent-over ends of the upper arms 7 and 8 of the reinforcement, which arms are located one on each side of the longitudinal centre-line 12 of the boot; (it will be recalled that this longitudinal centre line is a well-defined line determined by the moulding operation and which, in certain cases, may substantially constitute the plane of symmetry). These two upper arms 7 and 8 bear against a considerable portion of the rear of the upper 1 of the boot and they are held in this position by a clip 13 and is adapted to be slid over the two upper arms 7 and 8 (see FIG. 3). Advantageously this clip is made of bent sheet-metal and has an opening 14 through which can be passed a button 15 for preventing the clip 13 from sliding during ski-ing. This button 15 is secured to a leaf-spring, not illustrated, which is in turn firmly secured to the top end of the upper 1.

The collar 4 is placed in position before the reinforcement is clipped together and it is thus immobilised between this reinforcement 6 and the upper 1, so that the use of any other fixing means, such as rivets, resilient button-holes or the like, can be avoided. This results, on the one hand, in a considerable saving in the manufacture of this element and, on the other hand, in quicker and easier fitting thereof by the skier.

At the counter 16, that is to say at the zone where the collar 4 and the upper 1 join each other, the limbs of the reinforcement are bent, as stated previously, to an angle of approximately 50° so that the two lower arms 17 and 18 are formed.

Figure 4:
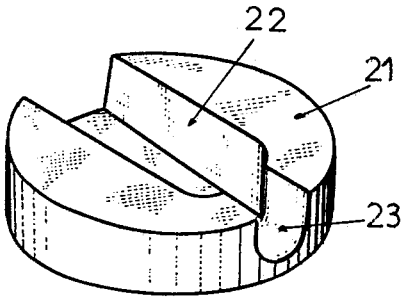
FIG. 4 is a view showing details of the channelled circular part containing the radial groove and its reduced portion.
Figure 5:
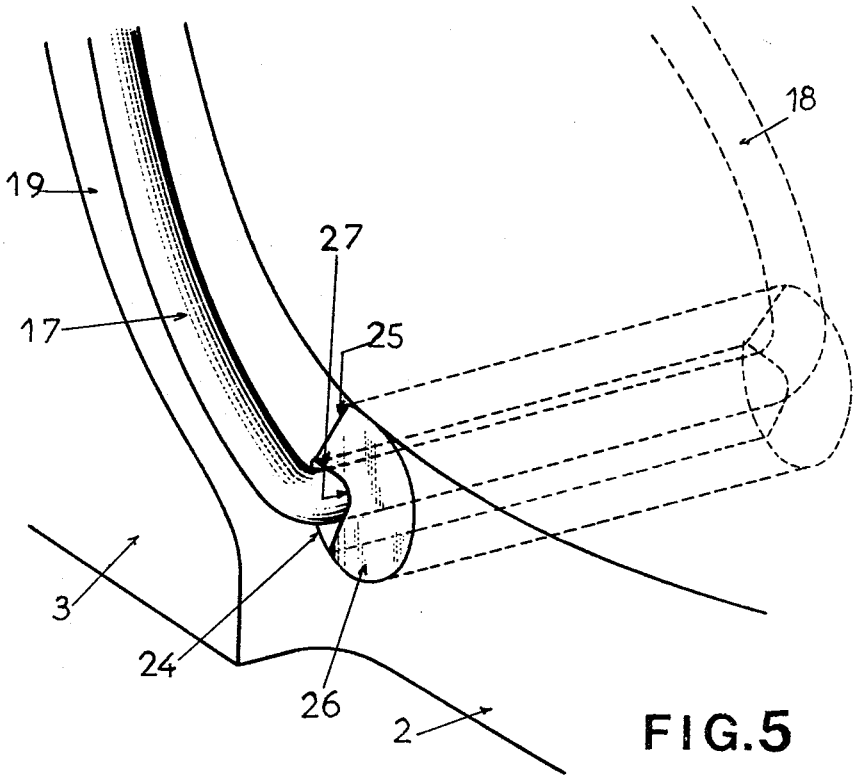
FIG. 5 is a sketch, on a larger scale, showing how the base of the U is passed through the recess formed in the sole of the boot.

The lower portion of the upper 1 has on each side of the boot:

a seating 19 adapted to receive one of the two lower arms 17 or 18 and to prevent it from projecting from the boot and a circular recess 20 adapted to accommodate a channelled part 21 shown in detail in FIGS. 4 and 5. This channelled part 21, also made of injection-moulded plastics material, is in the form of a disc having a groove 22 comprising a reduced portion 23, the width of which corresponds substantially to the diameter of the lower arm 18; part 21, which is held in position mainly by the limbs of the reinforcement is of slightly frusto-conical shape so that it can be clipped into the recess 20.

Finally, the lower horizontal base 9 of the U-shaped reinforcement 6 is located in a transverse recess 24, extending from one side of the sole 2 of the boot to the other, at the front portion of the heel 7. This recess 24, which includes a flat 25, substantially perpendicular to the lower arms 17 and 18 of the reinforcement (see FIG. 5), is adapted to receive a member 26 which forms a wedge and in which is cut a longitudinal notch 27 through which passes the horizontal base 9 of the U.

Figure 6:
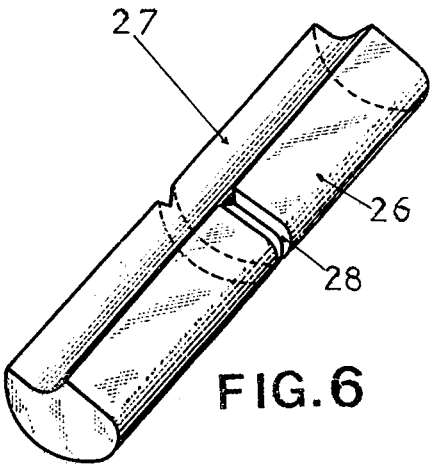
FIG. 6 shows the part which forms the wedge and in which is fitted the base of the U.

Formed midway along this wedge member 26 is a clip channel 28 adapted to receive an upstanding portion, not illustrated, situated within the recess 24 in the longitudinal centre-line 12 of the boot (FIG. 6).

When the boot is being assembled, the reinforcement 6 is positioned in the recess 24, the reinforcement 6 is pressed over, manually or mechanically, against the upper 1, and the bent-over ends of the upper arms 7 and 8 of the reinforcement are fitted in the oblong orifices 11 in the boss 10.

If the skier wishes to alter the initial setting, he presses the button 15 which yields and releases the clip 13. He then slides the clip towards the top of the boot and thus releases the two upper arms 7 and 8 of the U from the oblong holes 11. The skier then manually moves the upper arms 7 and 8 apart and swings the reinforcement 6 to the rear about the horizontal base 9.

Figures 8, 9:
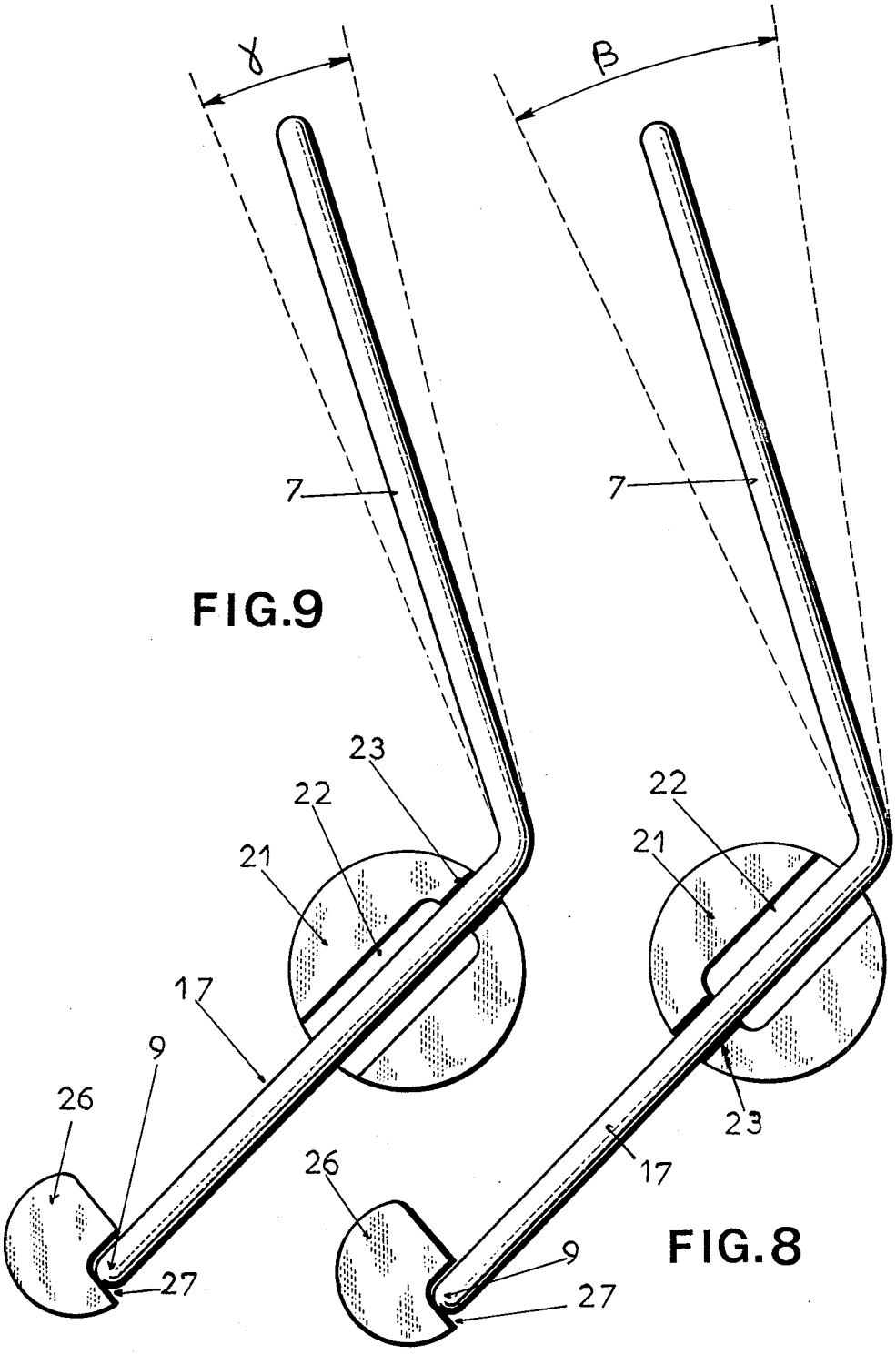
Figure 10:
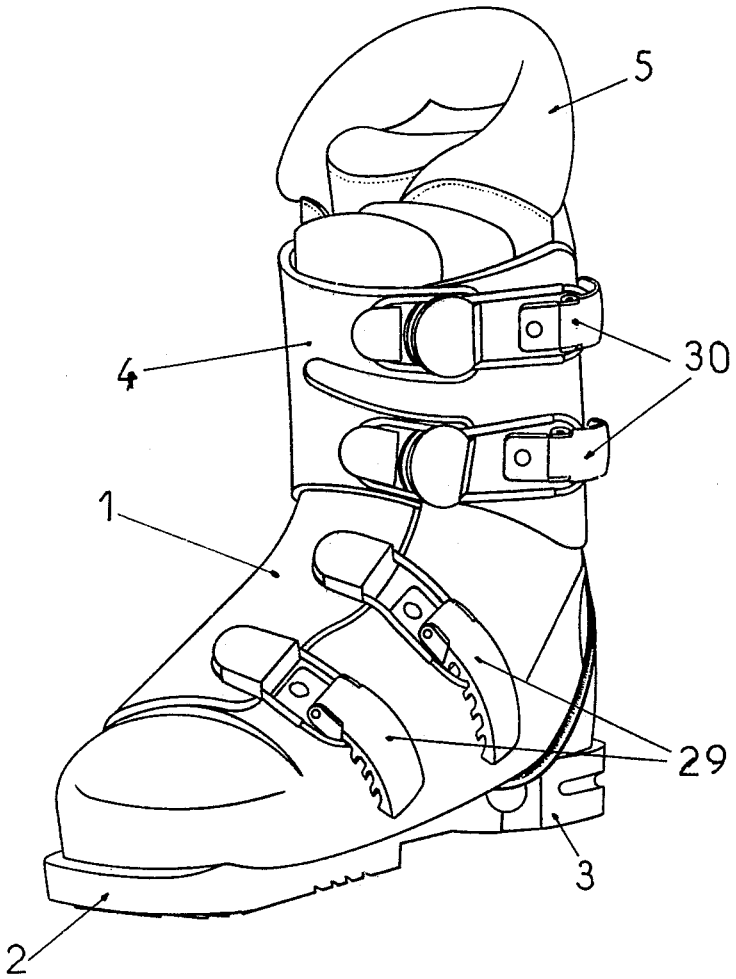
FIG. 10 is a three-quarter front view of the ski boot illustrated in FIGS. 1 and 2.

If the skier wishes to alter the flexibility of the boot, he turns the parts 21 in their seats 20 so that the reduced portion 23 is in the upper position, that is to say as far away as possible from the horizontal base 9 of the reinforcement or, on the other hand, as close as possible to this horizontal base 9 (see FIGS. 8 and 9). If required, an adjustment to the right and to the left can be carried out separately. It is also possible to choose a reinforcement 6 of a particular diameter for his own purpose, particularly in the case of boots for use in competitions.

On the other hand, when the skier wishes to alter the advance of the boot, that is to say the angle of flexion, he moves the wedge member 26, from the recess 24, and turns this wedge member 26 over so that the notch 27 is in the opposite position to the previous one. Thus the horizontal base 9 of the reinforcement is located either at the bottom and to the rear of the flat 25, or at the top and forwardly of the flat.

By combining the two types of adjustment, i.e. of flexibility and of advance, different possible fittings are obtained to suit the choice and requirements of the skier.

Finally the boot includes the conventional components, such as means for closing the upper 29 and means for closing the collar 30.

Figure 7:
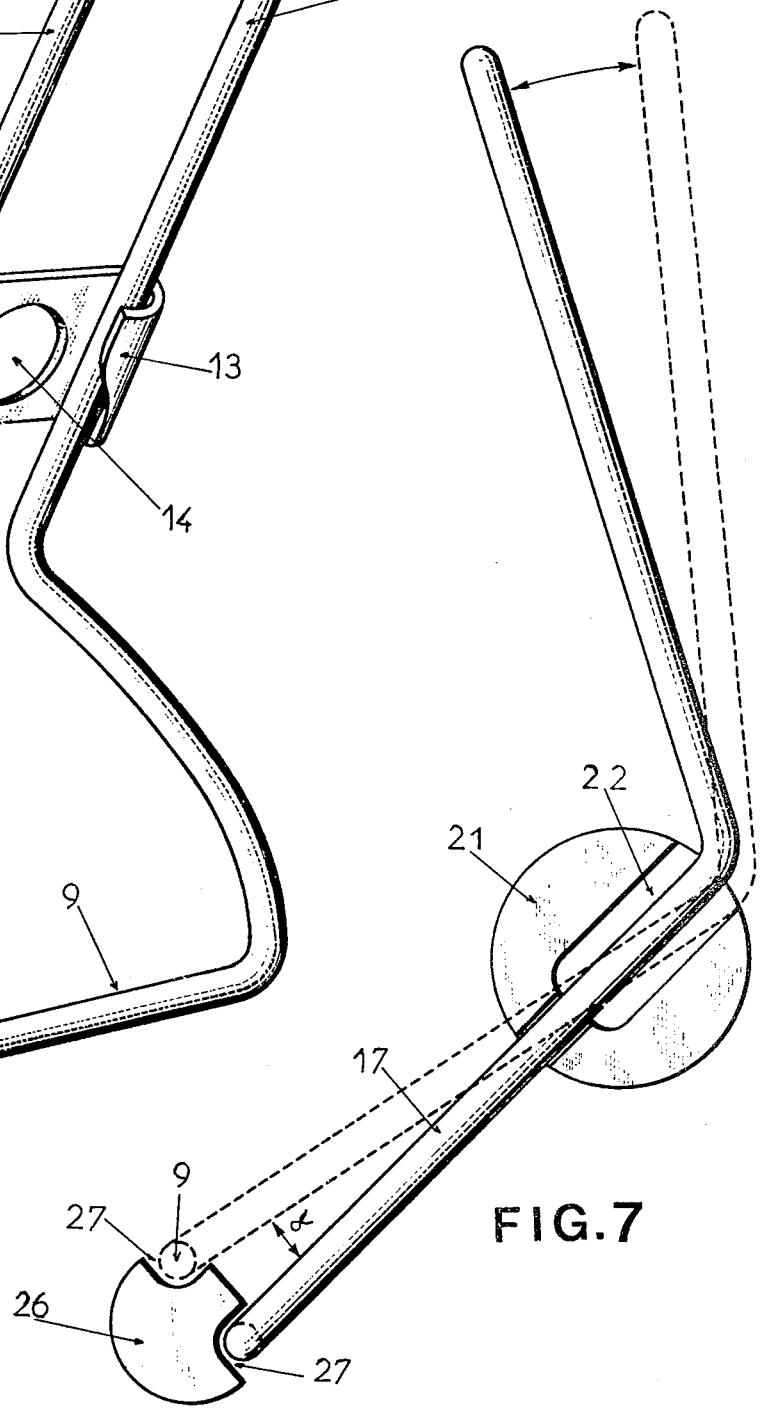
FIGS. 7, 8 and 9 are sketches which illustrate the mode of operation and the adjustments of the ski-boot in accordance with the invention.

FIG. 7 illustrates diagrammatically adjustment of advance. In this case, the angle of flexion, or advance, can vary over the angle $\alpha$, in relation to the natural balance of the skier, by displacement of the horizontal base 9 of the reinforcement into the upper position (continuous lines) or the lower position (broken lines). The position shown in continuous lines represents the normal position adopted by the average skier, and that shown in broken lines represents the bent position suited to the physique and the particular style of certain skiers.

FIGS. 8 and 9 illustrate diagrammatically the adjustment of flexibility by actuating the channelled part 21. Referring to FIG. 8, the upper arm 7 may have an angular play $\beta$ between the two end positions shown in broken lines. The distance between part 21 and the wedge member 26 is greater in FIG. 9 than this same distance in FIG. 8; (for example, in FIG. 9, the distance between the base 9 and the reduced portion 23 is more than one-third greater than this same distance in FIG. 8), and this gives a smaller amplitude $\gamma$. In other words, to increase flexibility, i.e. the amplitude of yield, it is necessary to reduce the distance between the bearing points of the base 9 and the reduced portion 23.

The ski-boot in accordance with the invention is notable mainly for:

excellent lateral rigidity, that is to say "angulation" rigidity, due to the presence of the rigid reinforcement 6, so that the taking of corners and therefore more precise guiding of the skis is facilitated;

advance that can be adjusted to suit the style and the physique of the skier;

variable flexibility which can be altered to suit the weight of the skier and the condition of the snow;

progressively increasing flexibility towards the front as well as towards the rear, since the reinforcement 6 flexes through several degrees under a minimum force, flexion of the reinforcement then requiring an increasingly heavier force up to a certain angle at which it no longer flexes, this taking place gradually so that impacts on the front of the tibia or on the base of the calf are eliminated:

reduced weight which permits thin walls of the boot to be used and therefore increases the moulding rate;

good reproducibility of performance whatever the outside temperature, since only the rigid reinforcement 6 plays a mechanical and dynamic part in the transmission of forces; and finally the fact that all adjustments are carried out without the use of any tool-kit.

All these features, which it has not been possible to combine in the moulded boots at present on the market, enable this ski-boot to be used with success particularly at competition level.

Finally, the simplicity of the design and construction of these boots protects them from corrosion, abrasion, risk of tearing, the state of the snow, frost and other climatic variables, and imparts a very high long-term strength.

It might also be mentioned that the boots in accordance with the invention may make use of interchangeable collars, i.e. collars which can be fitted either to the right boot or the left boot by simply being reversed. This feature makes it unnecessary to mould two kinds of collar which is an obvious economical advantage.

I claim:

1. An injection molded ski-boot of plastics, and preferably thermoplastics material, said boot comprising:

a rigid upper;

a rigid sole and heel integral with the upper;

a collar surrounding the top of the upper, effective to surround the leg of the wearer;

a U-shaped reinforcement;

a horizontal base on said reinforcement which extends through the sole near the heel;

limbs on the reinforcement which extend towards the top of the boot, said limbs being each situated at the rear of the boot, and which bear firmly against a major portion of the rear of the upper of the boot, one on each side of the longitudinal centre-line of the boot; and an upper arm on each limb, each upper arm being secured at a free end near to the top of the rear of the upper; and means on each side of the upper for adjustment of the position of the limbs.

2. A ski-boot as claimed in claim 1, in which the means for adjustment of the limbs comprises:

means defining the recesses symmetrical in relation to and on either side of the longitudinal centre-line of the boot;

two channelled parts each having means defining a radial groove for receiving a lower arm of said limbs, each of said recesses being adapted to receive the corresponding channelled part.

3. A ski-boot as claimed in claim 2, in which the groove has a reduced portion, the width of which corresponds substantially to the diameter of the lower arms of the limbs of the reinforcement.

4. A ski-boot as claimed in claim 2, in which the channelled part is of slightly frusto-conical shape so that it can be clipped into the recess.

5. A ski-boot as claimed in claim 1, and further comprising means for adjustment of the positioning of said horizontal base at the sole.

6. A ski-boot as claimed in claim 5, in which the means for adjustment has a transverse portion defining a recess in the sole which extends from one side of the boot to the other, in front of the heel, in which recess is lodged a member which forms a wedge and in which there is means defining a longitudinal notch for the base of the reinforcement to be passed therethrough.

7. A ski-boot as claimed in claim 6, in which the transverse recess is of substantially cylindrical shape and comprises a flat substantially perpendicular to the direction in which the lower arms of the limbs of the reinforcement extend.

8. A ski-boot as claimed in claim 6, in which the member which forms a wedge further comprises a clipping channel in which can be lodged an upstanding portion situated in the longitudinal centre-line of the boot and within the transverse recess.

9. A ski-boot as claimed in claim 1, and further comprising means for keeping the ends of the upper arms of the limbs in position near the top of the rear of the upper of the boot.

10. A ski-boot as claimed in claim 9, in which the means for holding the upper arms in position comprises a bent sheet-metal part adapted to slide along the upper arms of the limbs of the reinforcement.

11. A ski-boot according to claim 10, in which the bent sheet-metal part further comprises, at its centre, an opening adapted to form a passage for a resilient button connected to the rear end of the upper.

12. A ski-boot as claimed in claim 1, in which the angle of inclination of each upper arm with respect to its corresponding lower arm is between 30° and 70°.

13. A ski-boot as claimed in claim 1, and further comprising an integral boss located at the top portion of the rear of the upper, and means defining an oblong hole being cut into said boss, the free end of each of the upper arms of the limbs being lodged in said oblong hole.

14. A ski-boot as claimed in claim 1, in which the collar is fitted in the gap formed between the reinforcement and the upper.

15. A ski-boot as claimed in claim 1, and further comprising an oblique seating at the rear of the boot which is adapted to receive the lower arms of the limbs of the reinforcement.

16. In a ski-boot of the type having a rigid upper, a rigid sole and heel and a collar, an improved adjustment mechanism comprising:

a continuous member having a lower base portion approximately equal in length to the width of the heel and a pair of limb portions extending from the ends of said base, said limbs having a contour following the exterior of the boot from the heel, along the sides of the boot upper and upwardly along the rear of the boot upper in a generally parallel relation;

means on the heel of the boot for receiving said base;

guide means on the sides of the upper for locating said limbs; and means for securing the parallel portion of said limbs to the rear of the upper.

17. A ski-boot as claimed in claim 16 wherein said means on the heel is movable to adjust the position of said base thereby adjusting the advance.

18. A ski-boot as claimed in claim 16 wherein said guide means provides adjustable points of support for said member thereby providing flexibility adjustment.

* * * * *